United States Patent [19]

Schmidt

[11] 4,115,901

[45] Sep. 26, 1978

[54] LAUNDRY APPLIANCE DOOR HINGE

[75] Inventor: Bradley J. Schmidt, East Dundee, Ill.

[73] Assignee: Illinois Tool Works Inc., Chicago, Ill.

[21] Appl. No.: 821,650

[22] Filed: Aug. 4, 1977

[51] Int. Cl.[2] ..... E05D 7/12; E05D 5/10

[52] U.S. Cl. ..... 16/176; 16/168; 16/DIG. 13; 49/381; 49/386

[58] Field of Search ..... 16/137, 139, DIG. 13, 16/128 R, 149, 150, 168, 176; 49/381, 388, 400, 386

[56] References Cited

U.S. PATENT DOCUMENTS

| | | | |
|---|---|---|---|
| 259,176 | 6/1882 | Landis | 16/168 |
| 1,161,573 | 11/1915 | Young | 16/128 R |
| 2,040,191 | 5/1936 | Wanders | 217/57 |
| 2,239,648 | 4/1941 | Laubenstein | 16/168 |
| 2,745,133 | 5/1956 | McWethy | 16/150 |
| 2,904,853 | 9/1959 | Devery | 49/386 |
| 3,120,971 | 2/1964 | Bengtsson | 292/91 |
| 3,612,590 | 10/1971 | Andreini et al. | 292/76 |
| 3,659,314 | 5/1972 | Ross | 16/168 |
| 3,921,254 | 11/1975 | Foster, Jr. et al. | 16/176 |

FOREIGN PATENT DOCUMENTS

| | | | |
|---|---|---|---|
| 2,300,197 | 9/1976 | France | 16/DIG. 13 |
| 2,250,090 | 4/1973 | Fed. Rep. of Germany | 16/176 |

*Primary Examiner*—James Kee Chi

*Attorney, Agent, or Firm*—Olson, Trexler, Wolters, Bushnell & Fosse, Ltd.

[57] ABSTRACT

A one-piece molded plastic hinge member for a washing machine or other appliance door having integral starter attachment means for mounting to the appliance without auxiliary fasteners, an integral pintle for pivotal connection to a door, an upstanding stop element for limiting movement of the door, and an integral upstanding pad portion for preventing direct contact between the door and an adjacent part of the appliance.

12 Claims, 8 Drawing Figures

LAUNDRY APPLIANCE DOOR HINGE

BACKGROUND OF THE INVENTION

The present invention relates to a novel hinge construction, and more specifically to a novel hinge structure especially suitable for use in mounting a door or lid on an appliance such as a laundry or washing machine.

While it will become apparent that various features of the present invention may be adapted for mounting doors or lids in a wide variety of environments and structures, disclosure of the invention will be facilitated by particular reference to a hinge structure for mounting a door or lid on a laundry appliance such as a washing machine. As is well known, many washing machines comprise a sheet metal housing including a top member having an opening. A door or lid is hinged to the top member for selectively closing the opening. Heretofore, hinge structures for pivotally connecting the door to the top of the appliance have usually included multiple parts making assembly with the door and the appliance top relatively complex and expensive. Also, certain heretofore suggested structures have been such as to permit interference or interengagement between the top member and the door lid when the lid is fully opened, which interengagement may result in marring or damaging of the parts. For example, such parts in laundry appliances commonly have a vitreous porcelain or similar finish which may be scratched or chipped if parts such as the door and adjacent portions of the appliance cabinet or housing are allowed to come into contact with each other when the door is opened.

SUMMARY OF THE INVENTION

In view of the above, it is an important object of the present invention to provide a novel hinge structure particularly suitable for use in appliances such as laundry machines which is constructed for supporting a door or lid in a manner which will preclude direct contact between the door and adjacent portions of the appliance during movement of the door between fully opened and closed positions and particularly when the door is in a fully open position.

A further object of the present invention is to provide a novel hinge structure for an appliance door or the like which is adapted positively to stop the door at a fully open position while preventing direct contact between the door and adjacent portions of the appliance thereby minimizing any possibility of injuries or damage to the door or appliance cabinet.

A further important object of the present invention is to provide a novel hinge member for an appliance door or the like, which hinge member may be economically manufactured as a one-piece molded plastic part and is adapted to be operatively connected to and between both the door and an adjacent portion of the appliance housing or cabinet easily and without the aid of auxiliary fastening devices.

Still another object of the present invention is to provide a novel one-piece hinge member of the above-described type for mounting an appliance door to an adjacent portion of the housing or cabinet, which hinge member includes a pintle portion for pivotally supporting the door and stop means for locating the door at a fully opened position and supporting the door in a manner which reduces any possibility of injury or damage both to the door and to the pintle means.

Still another more specific object of the present invention is to provide a novel hinge structure for pivotally mounting a generally rectangular appliance door on the appliance cabinet, which hinge structure preferably includes a pair of one-piece molded plastic hinge members respectively connected with the door adjacent opposite corners thereof and also respectively connected to adjacent portions of the cabinet, each of said hinge members including a body portion for overlying the cabinet, an integral prong or attachment element for projecting through an aperture in the cabinet and securing the member with respect to the cabinet, an integral pintle element overlying the body portion for extending through a complementary aperture in the door, stop elements extending from the body member at opposite sides of the pintle for stopping and locating the door at a fully open position and for preventing interengagement between the door and adjacent parts of the cabinet, and a drive pin extending through the pintle and an adjacent aperture in the cabinet for positively securing the hinge member with respect to the cabinet.

Other objects and advantages will become apparent from the following description and the accompanying drawings.

DETAILED DESCRIPTION OF THE INVENTION

Figure 1:
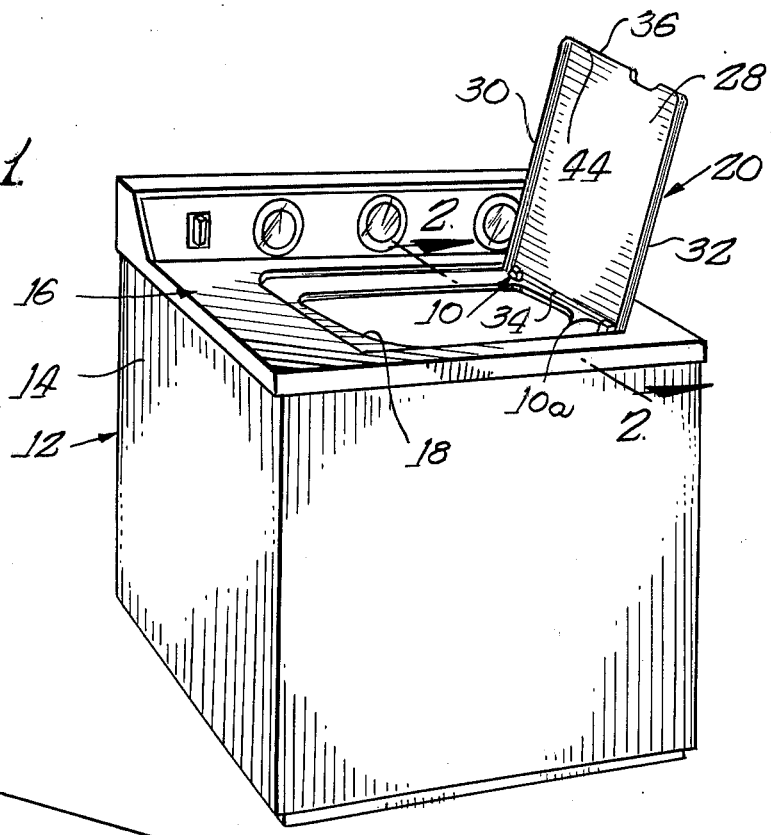
FIG. 1 is a perspective view showing a laundry appliance or washing machine including a hinge structure incorporating features of the present invention.
Figure 2:
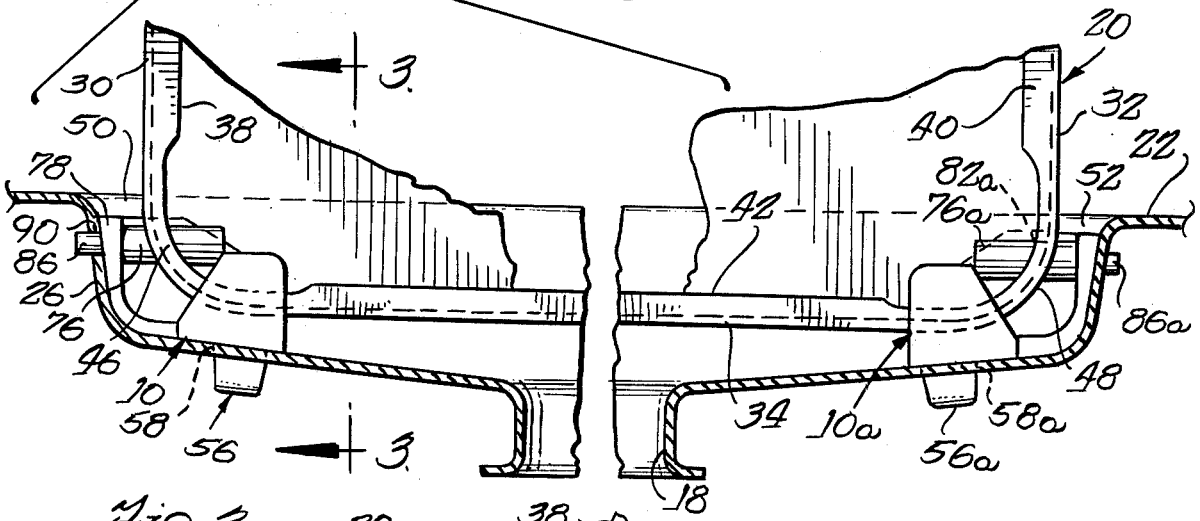
FIG. 2 is an enlarged fragmentary sectional view taken along line 2—2 in FIG. 1, with portions broken away, showing the hinge structure incorporating features of the present invention in greater detail.
Figure 3:
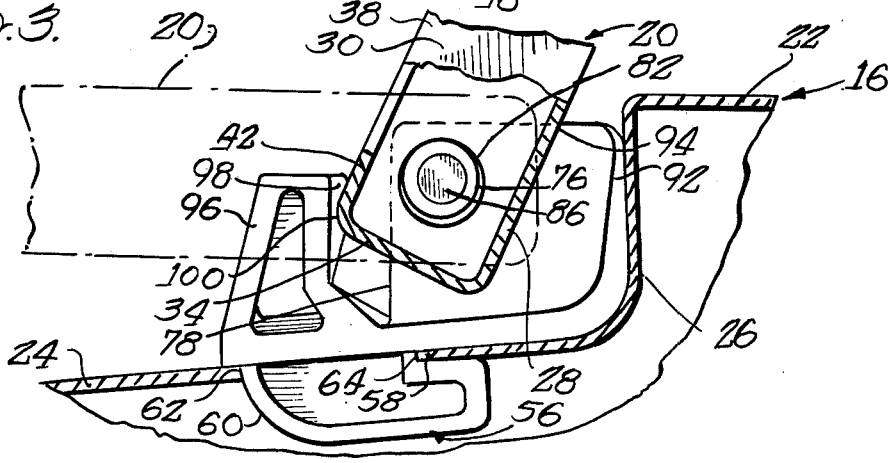
FIG. 3 is a further enlarged fragmentary sectional view taken along line 3—3 in FIG. 2.

Referring now more specifically to the drawings wherein like parts are designated by the same numerals throughout the various figures, a hinge structure including hinge members 10 and **10*a* incorporating features of the present invention is shown in an appliance 12 in FIGS. 1-3. As previously indicated, the hinge structure of the present invention may be incorporated into a wide variety of structures, but for purposes of illustrating a preferred embodiment, the appliance 12 is shown as a laundry or washing machine including a cabinet 14 having an upper wall or top member 16. An opening 18 is formed in the upper wall or top member 16 and a door or lid 20 is pivotally connected with the top member 16** by the hinge members 10 and 10*a* as will be described in detail below.

As shown in FIGS. 1–3, the appliance top member is formed generally in a known manner so that it includes an upper planar portion 22 and a recessed portion 24 surrounding the opening 18. The recessed wall portion 24 is shaped so as to accommodate the door 20 which, in the embodiment shown, has a rectangular peripheral shape. An upstanding wall section 26 extends between and joins the recessed wall portion 24 and the planar wall portion 22 of the top member, which upstanding wall section also has a generally rectangular peripheral configuration but is rounded at the corners.

The door 20 is preferably formed of sheet metal as is the top member 16 generally in a known manner. In the embodiment shown, the door member includes a planar top panel 28 of rectangular configuration. Integral opposite side sections 30 and 32 and opposite end sections 34 and 36 project from the top panel 28 and terminate in inturned flanges 38, 40, 42 and 44 respectively. The side and end sections 30–36 have a height which is similar to the height of adjacent portions of the connecting wall 26 so that when the door 20 is closed, its top panel 28 will be substantially coplanar with the flat top section 22 of the top member.

corner portions of the top member 20 are rounded so as to have a shape complementary to the rounded corner portions of the connecting wall 26. More specifically, as shown best in FIG. 2, side and endwalls 30 and 34 of the top member are connected by a rounded left hand corner portion 46 while the opposite or right hand corner of the door, as viewed in FIG. 2, is formed with a rounded corner portion 48 between the side and endwalls 32 and 34. As indicated above, adjacent corner portions 50 and 52 of the connecting wall 26 have a curved configuration generally complementary to the curved corner portions 46 and 48 of the door.

The hinge members 10 and 10*a* are essentially identical except that they are formed oppositely for assembly with opposite corners of the door. Therefore, only the left hand hinge member 10 will be described in detail herein with corresponding elements of hinge member 10*a* being designated by the same reference numerals on the drawings with the suffix *a* added.

Figure 6:
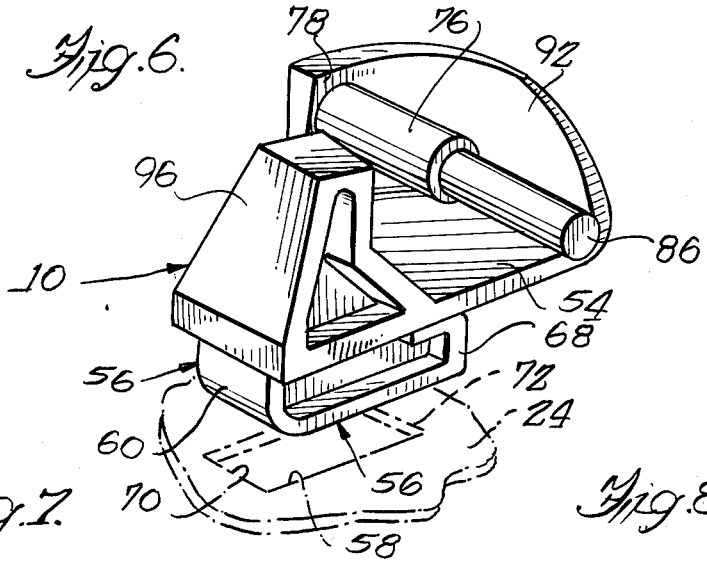
FIG. 6 is a perspective view showing a hinge member incorporating features of the present invention in an initial molded condition and further showing in broken lines an apertured portion of an appliance housing or cabinet with which the hinge member is to be assembled.
Figure 7:
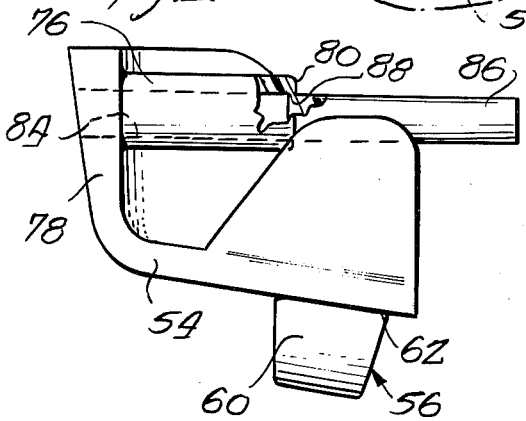
FIG. 7 is a fragmentary elevational view, partially broken away, of the hinge member shown in FIG. 6 as seen from the left hand end of FIG. 6.
Figure 8:
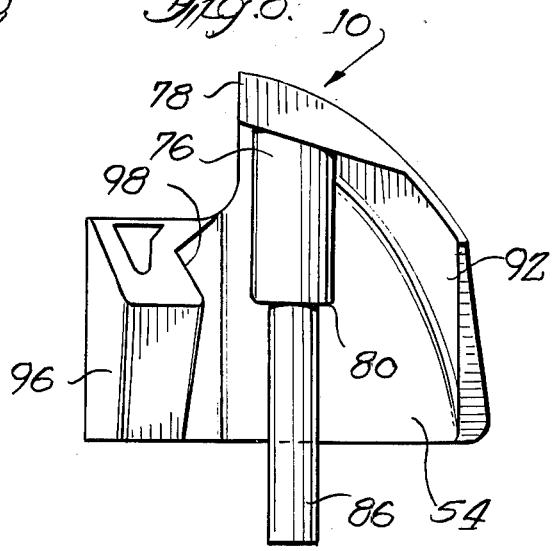
FIG. 8 is a plan view of the hinge member shown in FIG. 6.

As shown best in FIGS. 6, 7 and 8, the hinge member 10 is a one-piece device molded from a suitable tough resilient thermoplastic material such as nylon. The hinge member comprises a relatively broad flat base portion 54 adapted to overlie and conform to the surface of the sheet metal housing or cabinet portion 24 in the vicinity of the corner 50. In order to secure the hinge member with respect to the cabinet wall portion 24, an attachment prong or stud portion 56 extends generally axially from the body portion 54 for entry through a complementary shaped aperture 58 formed in the wall portion 24.

The prong or attachment stud portion 56 has a generally rectangular exterior configuration with opposite sides thereof relieved or recessed as shown in the drawings in order to minimize the amount of material included therein. As shown particularly in FIGS. 3–6, the stud portion 56 has one side edge wall 60 which curves from a junction 62 with the lower surface of the body portion 54 toward an opposite side edge of the prong. The opposite side edge of the prong includes a first section 64 extending generally perpendicularly from a junction 66 with the lower side of the body 54 for a distance approximately equal to the thickness of the stock material forming the recessed wall portion 24 of the washer top member. The side edge section 64 then merges with a laterally extending finger or shoulder element 68 projecting away from the curved edge 60 and presenting a shoulder surface 69 generally parallel to and spaced from the undersurface of the body portion 54 for defining a slot adapted to receive the wall portion 24 when the hinge member is assembled as will be described below. Preferably, the surface 69 is inclined downwardly and away from the underside of the head portion at a slight angle of, for example, 5° for facilitating assembly through the aperture 58 as described below.

Figure 4:
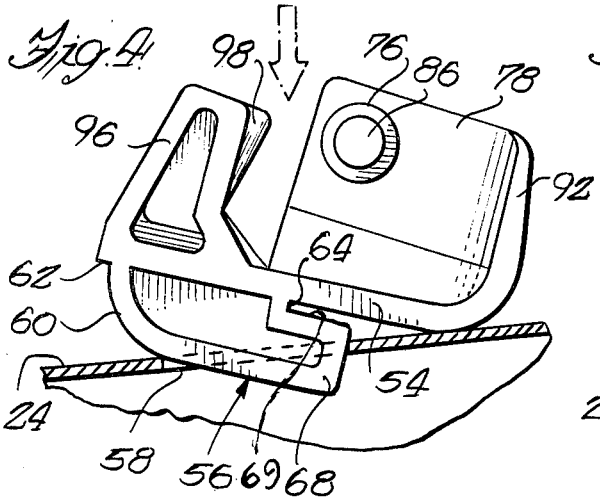
FIGS. 4 and 5 are fragmentary partial sectional views respectively showing successive steps in a procedure for assembling a hinge member incorporating features of the present invention with a complementary portion of an appliance housing or cabinet.
Figure 5:
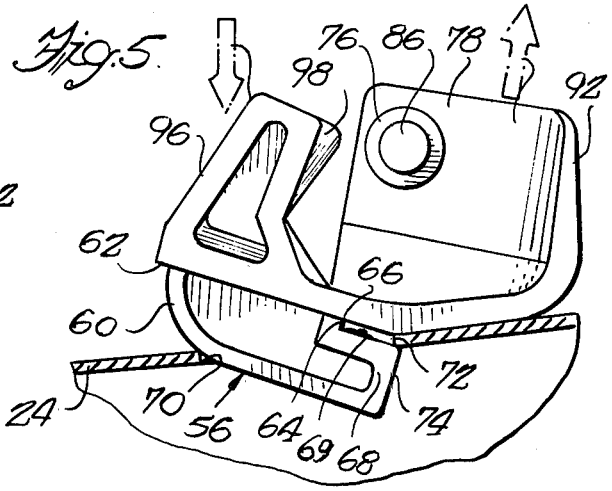

It is noted that the dimension between the side edge section 64 of the prong and the opposite side edge 60 substantially at the junction point 62 is similar to a corresponding dimension between opposite margins 70 and 72 of the aperture 58. However, the dimension between the junction point 62 and an opposite free end surface 74 of the finger element 68 is substantially greater. Therefore in order to assemble the prong through the aperture 58, the hinge member is first tilted relative to the wall section 24 and the finger portion is partially inserted as shown in FIG. 4. It will be seen that at this point in the assembly process, the head portion 54 begins to interfere with the wall section 24. Then, upon the application of downward pressure to the hinge member, the body member 54 is caused to flex in the manner indicated in FIG. 5 sufficiently to enable the end of the finger element 68 which is relatively rigid and unyielding to project through the aperture so that the margin 72 of the aperture enters the slot between the underside of the body portion 54 and the shoulder surface 69. Then the hinge member is pushed toward the right as viewed in FIG. 5 so as to advance the edge 72 into the slot and permit the curved edge 60 to slide through the aperture 58 as the body of the hinge member is rotated counterclockwise from the position shown in FIG. 5 to the position shown in FIG. 3. It will be appreciated that the device once assembled to the position shown in FIG. 3 cannot be removed without again flexing the body portion 54 so that the body portion serves effectively to retain the hinge member in assembled relationship with the washing machine recessed wall section 24.

In order pivotally to support the washer door, the hinge member 10 is provided with a pintle element or pin 76 having one end integral with a flange portion 78 which in turn is integrally joined with and extends upwardly from an outer side margin of the body portion 54. The arrangement is such that the pintle pin 76 is spaced above the body portion 54 and has a free end 80 adapted to be inserted through an aperture 82 in the side edge section 30 of the door in the vicinity of the corner portion 46 as shown in FIGS. 2 and 3. Preferably, the diameter of the aperture 82 is sufficiently greater than the diameter of the pintle so that a loose fit is provided for insuring free relative movement between the parts.

In the preferred embodiment disclosed herein, it will be noted that a bore 84 is formed through the pintle pin 76 and the side supporting flange 78. Furthermore, the device 10 is initially molded with a solid drive pin 86 integrally joined to the free end of the pintle along an annular frangible sheer section 88. The pin 86 has a diameter similar to but slightly greater than the diameter of the bore 84 and a length greater than the overall distance between the free end 80 of the pintle and the oppositely facing outer surface of the support flange 78.

The construction is such that after the hinge member 10 has been assembled with the washer top wall 24 in the manner described above, the pin 86 is adapted to be driven through the bore 84. As shown in FIG. 2, the upstanding flange portion 78 of the hinge member is disposed in close proximity to and conforms with the curved corner portion 50 of the washer top connecting section 26 and an aperture 90 is formed in the connecting section 26 in alignment with the bore 84. Thus, when the pin 86 is driven through the bore, it is also driven into an through the aperture 90. Of course, upon the application of sufficient axial pressure the frangible sheer section 88 is ruptured so as to permit the drive pin to pass through the bore 84 and, as indicated, the diameter of the pin is such as to provide an interference fit so that it is retained in the position shown in FIG. 2. In this position, the pin serves to provide a further positive interlock between the hinge member and the washer top so as to preclude accidental disassembly. The pin 86 also functions to reinforce the hollow pintle 76.

As shown in FIG. 3, the door 20 is adapted to be moved from the closed broken line position to the open solid line position. In accordance with features of the present invention, the hinge device 10 is provided with means for stopping and locating the door in the fully open position in a manner which precludes direct contact between the door and the washer top member 16 so as to minimize any possibility of marring or chipping of the enamel or porcelain on the sheet metal parts and also so as to minimize stresses which might damage the pintle 76. More specifically, the hinge member is provided with an upstanding stop and cushion flange portion 92 along a margin of the body member 54 spaced rearwardly from the pintle 76. The flange 92 merges with and is a continuation of the flange 78 and is shaped so as to conform with the curved corner portion 50 of the washer top connecting section 26. As shown best in FIG. 3, the flange 92 has a vertical extent or height similar to that of the connecting section 26 so as to provide a shield or pad between the sheet metal door 20 and the sheet metal connecting section 26 of the washer top member so as to preclude direct contact between these parts. Furthermore, when the door is in the fully opened position as shown in FIG. 3, the door may engage the flange 92 at area 94. Since the flange 92 is backed up and reinforced by the sheet metal connecting section 26, further movement of the door is precluded. At the same time, however, the relative softness or resiliency of the plastic material from which the hinge member is formed minimizes any possibility of damage to the door.

In addition to the flange 92, the hinge member is provided with an upstanding abutment element or stop 96 integral with the body portion 54 and located forwardly of the pintle 76. The stop element 96 includes an abutment surface 98 located for engagement with the edge section 34 of the door at area 100 when the door is in the fully open position as shown in FIG. 3. Preferably, the abutment surface 98 is inclined upwardly and rearwardly so as to insure maintaining contact with the door even though the abutment element resiliently yields or flexes under the weight or force of the door. Furthermore, the abutment surface is preferably located so that it is engaged by the door before and while the door engages the flange 92 at the area 94. The arrangement is such that substantial portions of any shock loads imposed on the hinge member during opening of the door are borne by the abutment areas 94 and 100 whereby any possibility of damage to the pintle 76 is minimized.

While various procedures may be adopted for assembling the hinge members 10 and **10*a* with the door and washer cabinet to provide the hinge structure of the present invention, a preferred method of assembly contemplates that one of the hinge members, for example hinge member 10, should first be assembled with the cabinet top member in the manner described above. Then the pintle 76*a* of the other hinge member 10*a* with its drive pin intact is inserted through an aperture 82*a* in the door edge 32 corresponding to the above described aperture 82. The door is then assembled with the pintle 76 of the hinge member 10 whereupon the hinge member 10*a* is positioned so as to align its attachment element or prong 56*a* with an aperture 58*a* in the recessed wall 24 corresponding to the above described aperture 58. Finally, the prong 56*a* is inserted through the aperture 58*a* and the drive pin 86*a* is forced through the pintle 76*a* and an aligned aperture in the connecting section 26 to achieve the finally assembled condition shown in FIG. 2**.

While a preferred embodiment of the present invention has been shown and described herein, it is obvious that many structural details may be changed without departing from the spirit and scope of the appended claims.

The invention is claimed as follows:

1. A one-piece molded plastic hinge member for mounting a door on an appliance or other support structure of the type described having an aperture therethrough, said hinge member comprising a body portion for overlying said support structure, an integral attachment prong portion projecting in one direction from said body portion for insertion through said aperture and securing the hinge member to said support structure, a pintle spaced from said body portion oppositely from said prong portion for pivotal connection with a door to be mounted, a support element integrally joining said pintle and said body portion, and an integral pad element located at a position behind said pintle for engaging a door supported by the pintle when said door is in an open position and preventing substantial contact between said door and any adjacent part of the support structure, and a stop element integral with said body portion and projecting therefrom in a direction opposite from said attachment portion and at a location forwardly of said pintle for engaging a door supported by the pintle at a side of the pintle opposite from said pad element when the door is in said open position for resisting further opening of the door.

2. A hinge member, as defined in claim 1, wherein said pintle includes bore means extending axially therethrough, said hinge member further including a drive pin integrally joined along a rupturable section with said pintle in alignment with said bore means, said drive pin, upon rupturing of said section, being movable through said bore means into interengagement with a support structure on which the hinge member is mounted for further securing the hinge member with respect to the support structure.

3. A hinge member, as defined in claim 1, wherein said prong portion includes substantially rigid shoulder means spaced from said body portion for engagement behind said support structure when the hinge member is assembled with the support structure, said prong portion including a rounded surface disposed oppositely from said shoulder means for enabling the prong portion to be inserted through said aperture by first inserting the shoulder means and positioning the shoulder means behind said support structure and then rotating the hinge member relative to the support structure for advancing the remainder of the prong portion through the aperture.

4. The hinge member molded of resilient plastic material as defined in claim 3 wherein said body portion includes a resiliently yieldable part generally oppositely from said shoulder means, said yieldable part being adapted to be flexed during assembly of the prong portion through said aperture and combining with said shoulder element for restraining unauthorized disassembly of the hinge member from said support structure.

5. A one-piece hinge member of molded resilient tough plastic material for mounting a door on an appliance of the type described having a sheet material wall including a planar portion, a recessed section and an upstanding connecting section therebetween and aperture means through said recessed section adjacent said connecting section, said hinge member comprising a body portion for overlying said recessed section, an integral attachment prong portion projecting in one direction from said body portion for insertion through said aperture means and securing the hinge member with respect to said recessed section, an integral support element extending from said body portion generally oppositely from said prong portion, a pintle spaced from said body portion and including one end integral with said support element and an opposite free end for pivotal connection with a door to be mounted, and an abutment element integral with said body portion and located forwardly of said pintle and presenting an abutment surface for engaging a door supported by the pintle when the door is in an open position and resisting further opening of the door and bore means extending axially through said pintle and opening through said support element, a drive pin extending from said free end of the pintle in alignment with said bore means, and a rupturable connecting element integrally connecting said drive pin and pintle and adapted to be severed for enabling the drive pin to be forced through said bore means for interengagement with said connecting wall section and further securing the hinge member with respect to the appliance when the hinge member is fully assembled.

6. A hinge member, as defined in claim 5, which includes a pad element integral with said body portion and projecting in a direction opposite from said prong means at a location spaced from and rearwardly of said pintle for engaging a door supported on the pintle when the door is in a fully opened position and preventing substantial contact between said door and any adjacent part of said appliance.

7. In an appliance such as a laundry machine having a sheet metal top member including a generally planar portion, a recessed portion surrounding a machine access opening and an upstanding connecting section of generally rectangular configuration between said planar and recessed portions, said recessed portion having apertures therethrough adjacent opposite corners of said generally rectangular connecting section, and a generally rectangular door for overlying said machine access opening and having a configuration for fitting within said generally rectangular connecting section; a hinge structure comprising in combination first and second hinge members molded of tough resilient plastic material and respectively disposed adjacent said opposite corners of said rectangular connecting section in association with adjacent corner portions of said door, each of said hinge members comprising a body portion overlying said recessed portion of the top member, an attachment prong portion integral with said body portion and projecting in one direction therefrom through one of said apertures in said recessed portion for securing the hinge member with respect to said recessed portion, a support element integral with said body portion and extending therefrom oppositely from said prong portion along an adjacent part of said connecting section, a pintle having one end integral with said support element and a free end extending over and in spaced relationship to said body portion and pivotally connected with said door, said door being movable between a closed position overlying said access opening and a generally upwardly extending fully opened position, and means integral with said body portion and extending upwardly therefrom in spaced relationship with respect to said pintle for engaging said door when the door is in said opened position and resisting further opening movement of the door.

8. A hinge structure, as defined in claim 7, which further includes bore means extending axially through said pintle and opening through said support element, said connecting section having an aperture therethrough in alignment with said bore means, and a drive pin within said pintle and extending through said bore means and projecting into said last mentioned aperture for further securing the hinge member with respect to the appliance top member.

9. A hinge structure, as defined in claim 8, wherein said means integral with said body portion and disposed for engagement with the door when the door is in the opened position includes a pad element disposed rearwardly of said pintle and engageable with the door for preventing contact between the door and any part of said appliance top member.

10. A hinge structure, as defined in claim 9, wherein each of said hinge members further includes a stop element integral with said body portion and projecting upwardly therefrom at a location disposed forwardly of said pintle, said stop element presenting an abutment surface engageable with said door for further resisting movement of the door passed the fully opened position.

11. A structure, as defined in claim 9, wherein said opposite corners of said generally rectangular connecting section are rounded, and said supporting element and upstanding pad element comprise merging flange means having a rounded exterior configuration substantially conforming to the adjacent rounded corner of said connecting section.

12. A one-piece hinge member of molded resilient tough plastic material for mounting a door on an appliance of the type described having a sheet material wall including a generally planar portion, a recessed section and an upstanding connecting section therebetween and first aperture means through said recessed section adjacent said connecting section and second aperture means in said connecting section in the vicinity of said first aperture means, said hinge means comprising a body portion for overlying said recessed section, an integral attachment prong portion projecting in one direction from said body portion for insertion through said first aperture means and securing the hinge member with respect to said recessed section, an integral support element extending from said body portion generally oppositely from said prong portion, a pintle spaced from said body portion and including one end integral with said support element and an opposite end for pivotal connection with a door to be mounted, bore means extending axially through said pintle, a drive pin extending from said opposite end of the pintle in alignment with said bore means, and a rupturable connecting element integrally connecting said drive pin and pintle and adapted to be severed for enabling the drive pin to be forced through said bore means and into said second aperture in the connecting section for further securing the hinge member with respect to the appliance when the hinge member is fully assembled.

* * * * *